US010214335B2

(12) United States Patent
Tinoco

(10) Patent No.: US 10,214,335 B2
(45) Date of Patent: Feb. 26, 2019

(54) TAMPER EVIDENCE FEATURE

(71) Applicant: LaserSharp FlexPak services, LLC, Vadnais Heights, MN (US)

(72) Inventor: Juan Carlos Tinoco, Vadnaic Heights, MN (US)

(73) Assignee: LaserSharp FlexPak services, LLC, Vadnais Heights, MN (US)

( * ) Notice: Subject to any disclaimer, the term of this patent is extended or adjusted under 35 U.S.C. 154(b) by 525 days.

(21) Appl. No.: 14/757,814

(22) Filed: Dec. 23, 2015

(65) Prior Publication Data

US 2016/0221740 A1 Aug. 4, 2016

Related U.S. Application Data

(60) Provisional application No. 62/095,991, filed on Dec. 23, 2014.

(51) Int. Cl.
*B65D 77/20* (2006.01)
*B65D 75/58* (2006.01)

(52) U.S. Cl.
CPC ..... *B65D 75/5855* (2013.01); *B65D 77/204* (2013.01); *B65D 77/2096* (2013.01); *B65D 2201/00* (2013.01); *B65D 2203/12* (2013.01); *B65D 2575/586* (2013.01)

(58) Field of Classification Search
CPC ... B65D 77/20; B65D 77/204; Y10T 29/5333; Y10S 493/961
USPC ..... 206/459.1; 40/312, 674
See application file for complete search history.

(56) References Cited

U.S. PATENT DOCUMENTS 4,793,486 A * 12/1988 Konopka ..... A61M 5/1417 206/305
6,688,023 B1 * 2/2004 Gwen ..... A44C 3/001 40/1.6

* cited by examiner

*Primary Examiner* — King M Chu
(74) *Attorney, Agent, or Firm* — Law Office of Scott C. Harris, Inc

(57) ABSTRACT

A spiral part used as a tamper evident feature an a peal reclose label. The spiral is formed on a pressure sensitive adhesive label, and the spiral is unraveled in order to open the package. Once unraveled, it is difficult to reclose the package with the spiral in its original place. In one embodiment, there is a special color to the label, so that once the package is opened, it can be seen.

25 Claims, 10 Drawing Sheets

TAMPER EVIDENCE FEATURE

This application claims priority from Provisional application No. 62/095,991, filed Dec. 23, 2014, the entire contents of which are herewith incorporated by reference.

BACKGROUND

In recent years several companies have supplied a variety of peel-reclose packages.

The inventors have recognized the desirability of tamper evidence on such packages, e.g., an indication for the consumer that the package has been opened prior to purchasing the item.

Our previous patent applications have described different ways of providing tamper evident systems on a peel reclose package. For example, our application Ser. No. 13/899,387, filed May 21, 2013, describes using a laser to score tamper evident features on a package. Other technology can also be used to die cut complex patterns into packaging materials. It can also be imagined that one could apply special tamper proof labels to a packaging material, or a combination thereof.

SUMMARY

The present application describes special techniques for a tamper evident package. According to one embodiment, a special spiral is formed on the package which is unraveled when the package is opened. That under woven spiral can be easily seen so that it can be determined that the package has already been opened. In one embodiment, there is also a visual indicator or print in the area of the spiral to indicate at a glance that the package has been opened.

DETAILED DESCRIPTION

The invention and the disclosed embodiments relate to the creation of a new tamper evident feature for peel-reclose packages that are used to open and re-close a package. Embodiments describe tamper evident features being created to readily indicate if the package has been tampered with or opened before the consumer buys the product.

According to an embodiment, a concentric or spiral pattern is created within a pressure sensitive adhesive ("PSA") label. The concentric pattern as described herein can be laser cut or mechanically die cut; however according to a more preferred embodiment, the pattern is laser cut to provide both precise registration, and also to provide more resolution in the cutting. The term spiral is used herein means that there are a number of different concentric shapes which are nested within one another, and each of the concentric shapes is within another of the concentric shapes. The value N is used herein to indicate the number of concentric shapes which are stacked one within the other.

This feature can be manufactured in line during the production of the PSA label or can be manufactured after the production of the initial PSA label. The embodiments describe the concentric pattern being of multiple different spiral shapes including circular, square, elliptical, or triangular. Preferred embodiments of these shapes are concentric in the sense that they wind around a centroid point at a continuously increasing from the centroid. It is understood that this concept could be applied to other shapes and that the distance around this centroid could increase or change proportionally, or non proportionally.

Figure 5:
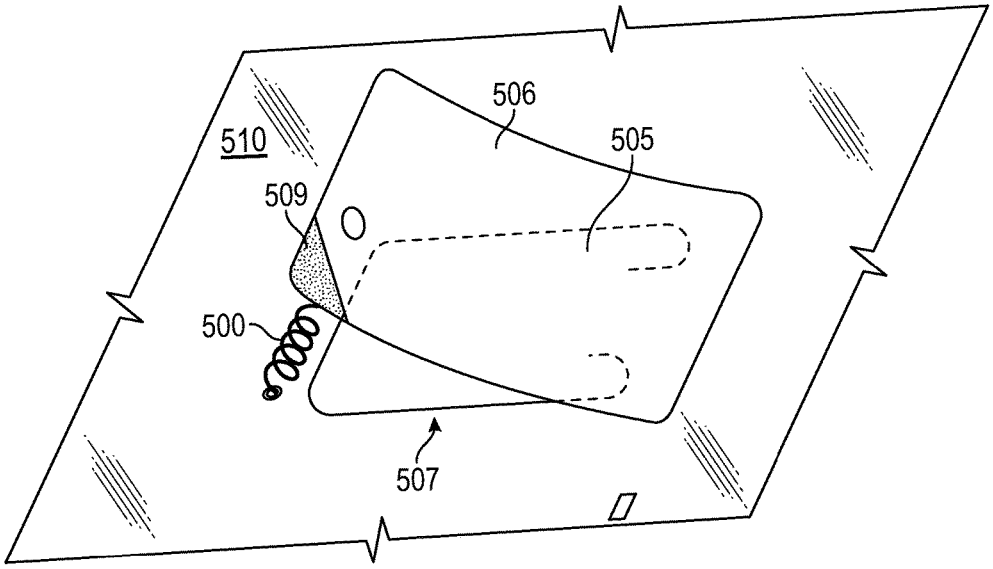
FIG. 5 illustrates a first section of the tamper evident package being opened, showing the spiral unraveling as the opening occurs.

For peel-reclose package designs that use a PSA label to open the package, the basic opening operation can be seen in FIG. 5. FIG. 5 shows a PSA label 505 that attaches to the package material 510. When attached, the PSA label 505 has a perimeter 506 that is larger than a corresponding opening 507 within the packaging material. Hence, the edges of the PSA label wholly seals the opening in the package when the PSA label 505 is attached to the packaging material. Moreover, an area of the PSA label 505 between the edge of the opening and the outer edge of the PSA level, referred to herein as the sealing area, holds to the package, thus sealing the package using the PSA label.

In operation, the package is opened by the consumer peeling back the PSA label, where it is adhered to the sealing area on the package. One portion of the label, preferably a portion adjacent to a pull portion 509 which is intended to be held for opening by the package user, includes the tamper evident portion. The pull portion could be located at any location within the PSA label, for example, may be formed from an area in a corner of the PSA label which has no or less adhesive thereon. Alternatively, the pull portion may be a special tab that extends out from the PSA label, making it evident that the user can pull on that tab.

As the PSA label is opened, the tamper evident feature is first stretched into a released coil or helix 500 as shown in FIG. 5. Initially, while the package is opened, that coil or helix portion will unwind to become a three dimensional helix or coil 500 while remaining attached to both the PSA label and the packaging material as shown in FIG. 5.

Figure 6:
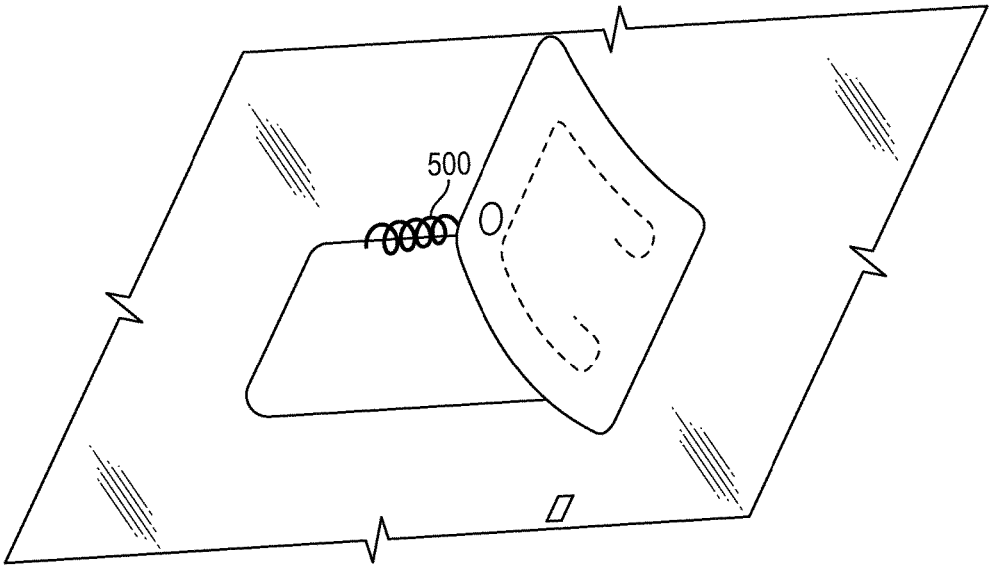
FIG. 6 illustrates the package completely open and shows the broken helix or coil.

As the package continues to be opened, the helix or coil 500 will stretch and break or separate from the packaging material as the PSA label is pulled back, as shown in FIG. 6.

Figure 7:
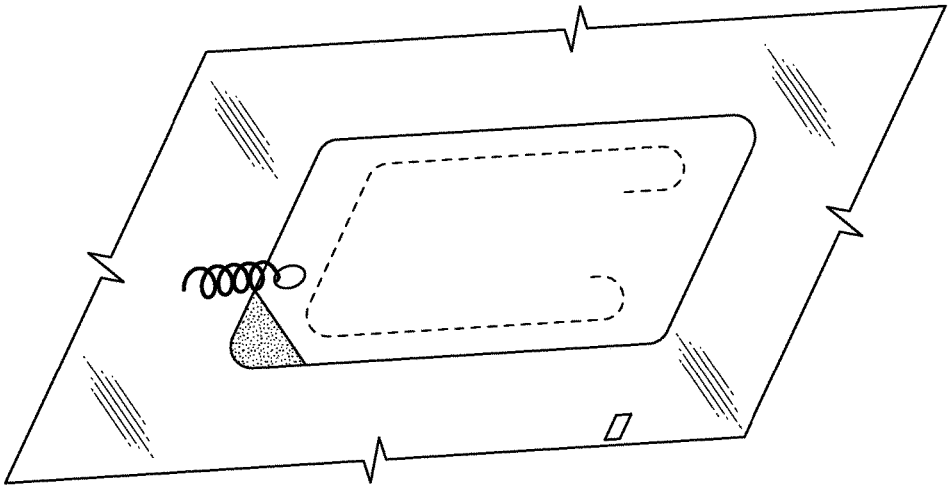
FIG. 7 shows the package being reclosed with the helix or coil not in its original location.

Once separated from the packaging film, the helix or coil 500 remains attached to the PSA label and will be very difficult to place back to its original position when the package is reclosed. FIG. 7 shows how closing the package after once opening causes the helix or coil 500 to either extend outside the PSA label, as shown in FIG. 7, or alternatively to form a bump where the coil has been pressed under the label. Closing and even sealing the package after once opening is still possible, but it becomes evident that the helix or coil 500 has been removed from its initial configuration.

The embodiment of FIG. 5 shows a single tamper evident feature, however in other embodiments, multiple of these tamper evident features can be provided in different places within the sealing area.

FIG. 1 illustrates a PSA label 100 with first and second spiral tamper evident features 105 and 110. Both of these features are located within the sealing area 115 of the PSA label. One or more of these tamper evident features all can be manufactured in registration with the PSA label, at any location within the sealing area of the PSA label.

The PSA label can be clear or printed, and similarly, the Packaging film can be clear, colored or printed, in different embodiments. In a particularly preferred embodiment described with reference to FIGS. 9-16, the coloring could also be a portion of the tamper evidence, where the coloring is consistent in one embodiment prior to opening, and interrupted in that embodiment after opening. In another embodiment, printing or a graphic design is provided in one embodiment that is interrupted when the opening is first carried out.

The tamper evident feature can be of any size or diameter "D" that fits within the sealing area. Preferably, as shown, less than about two thirds of the distance between package opening and edge of the PSA label is taken by the tamper evident feature. Resealing will only be able to seal using that surface area that is not taken by the tamper evident feature.

Figure 1A:
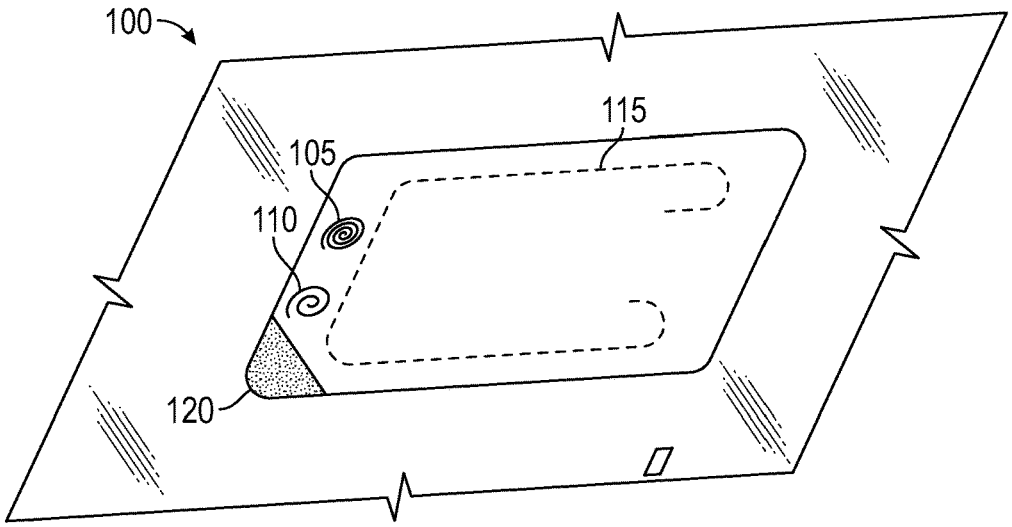
FIG. 1A-1C show a first embodiment using aspiral tamper evident feature where the spiral is a circular spiral.
Figure 1B:
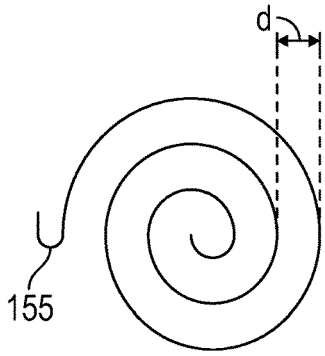
Figure 1C:
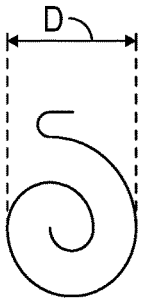

The spiral can have dimensions and features as shown in FIGS. 1B and 1C. The distance d is the distance between the loops or revolutions as FIG. 1B. The value N represents the number of revolutions or loops around the center point. FIG. 1B shows a spiral tamper evident feature that has three revolutions or loops, where N=3 in FIG. 1B. The end of the helix or coil, can include a hook shape 155 that is attached to the PSA Label, such that it assists in stretching the helix or coil before breaking off from the Packaging Material. The hook shape 155 at the end of the spiral helps to prevent the cut in the PSA label that is opened by opening the package, from ripening or propagating into the PSA Label. The hook shape can be at the end of the spiral as shown, and/or at the other end or both ends. The hook shape can be a curve that faces away from the direction of the tearing or opening of the label to resist against propagation.

The value N should be set so that the spiral shape has an overall length which is less than a distance between the label and the packaging material when the label is fully opened from the packaging material FIG. 1C illustrates a different spiral loop where N=2.

One embodiment orients the concentric design in a particular location relative to a peel point 120.

Figure 2A:
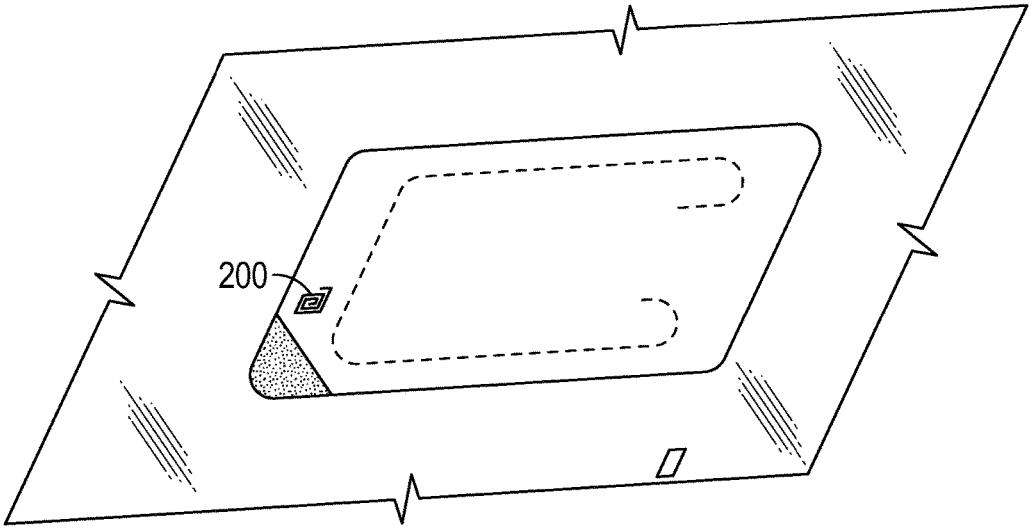
FIGS. 2A-2B show a rectangular spiral used as the tamper evident feature.
Figure 2B:
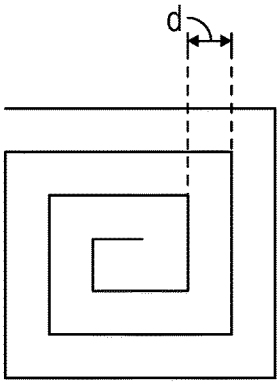

FIG. 1A-1C shows a circular spiral. Alternative embodiments can use a square or rectangular spiral, in FIG. 2A and 2B, where the tamper evident feature 200 in FIG. 2A is a square revolution. FIG. 2B illustrates how the same values D, d and N define the spiral. In FIG. 2B, N=3.

Figure 3A:
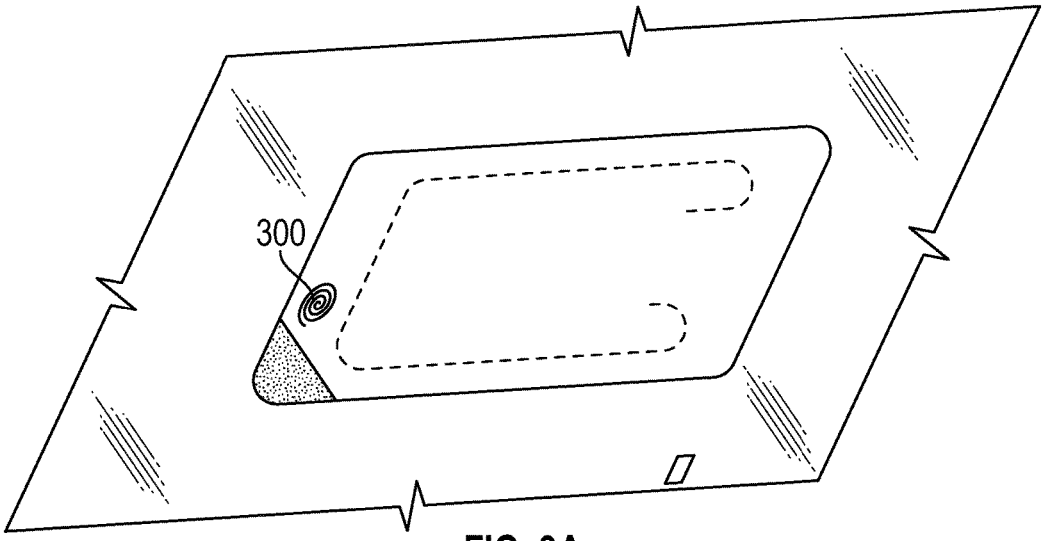
FIG. 3A-3C show an ellipse spiral used as the tamper evident feature.
Figure 3B:
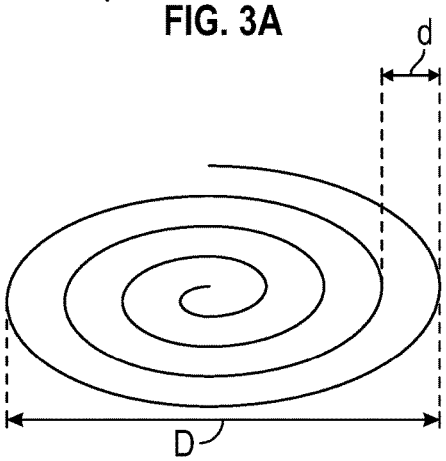
Figure 3C:
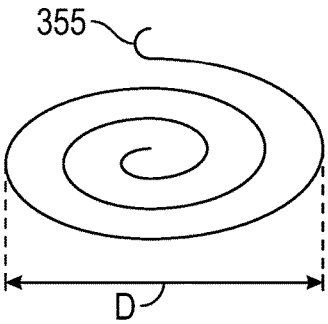

FIG. 3A-3C show an alternative embodiment where the tamper evident feature is elliptical. Elliptical tamper evident feature 300 in FIG. 3A can form more revolutions in a similar size sealing area since the long axis of the ellipse can be placed in the longer area of the sealing area. For example, FIG. 3B shows an N=4 spiral and how that can more easily fit within the sealing area while still leaving ⅓ of the distance between edge of the opening and outside of the PSA label.

FIG. 3C shows an N=3 revolution ellipse, which like in the FIG. 1 embodiment includes a hook anchor to help prevent propagation of the opening.

Figure 4A:
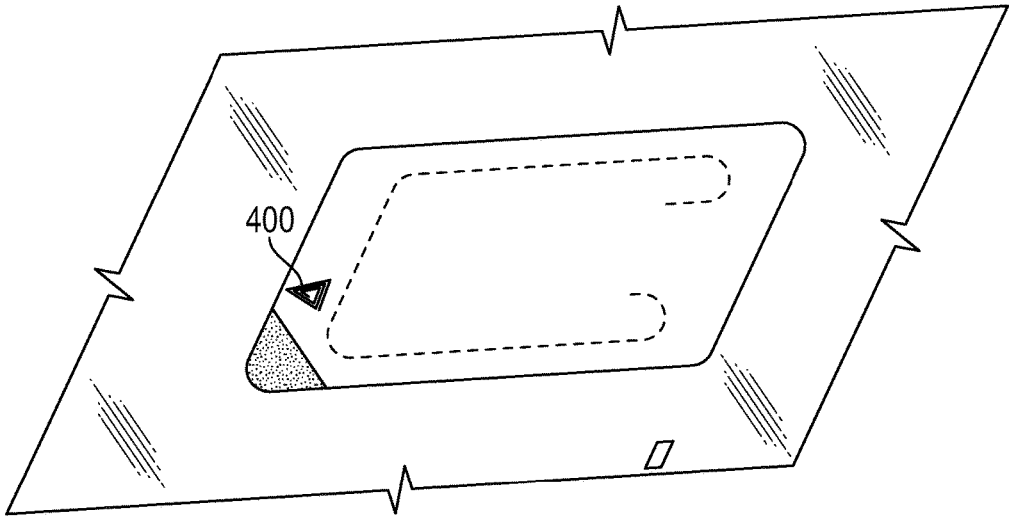
FIGS. 4A-4B shown a triangular spiral used as the tamper evident feature.
Figure 4B:
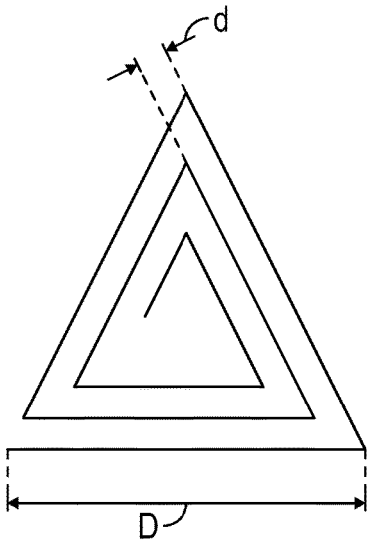

FIG. 4A illustrates a triangular spiral tamper evident feature 400. The triangular shape operates much the same as the embodiments of FIGS. 1-3. The different shapes may each have their own host of advantages. For example, the triangular shape may be particularly difficult to fit back into its original position, due to the complexity of the shape.

Figure 8:
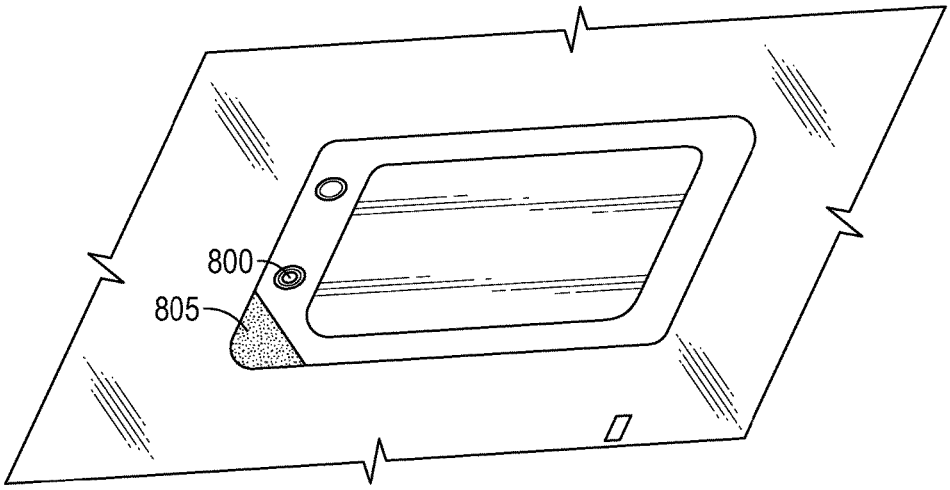
FIG. 8 shows a second embodiment in which the area of the coil is an area of consistent color or it is printed.

FIG. 8 shows a specific embodiment of a peel-reclose package and material which uses an interruption in a viewable area in order to display evidence of once opening. The embodiment of FIG. 8 illustrates the interruption being in a consistent colored area. The PSA label shown in FIG. 8 is applied on a clear packaging material manufactured in a continuous web. The top portion 800 is shown as being continuously colored or printed, next to the area of the pull tab 805. Note that there are no interruptions in the colored or printed area 800, since the package has not yet been opened.

Figure 9:
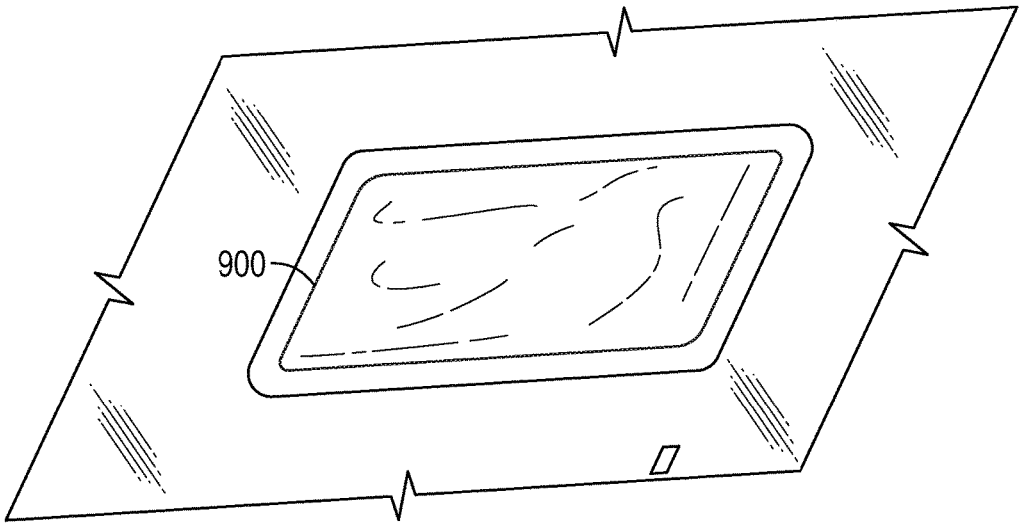
FIG. 9 shows a rear portion of the label.

FIG. 9 shows the rear surface packaging material surface opposite of the surface with the applied PSA label, where a laser or die cut into the packaging web inside the perimeter of the PSA label. The cut 900 forms the opening feature, in generally a rectangular U-shape.

Figure 10:
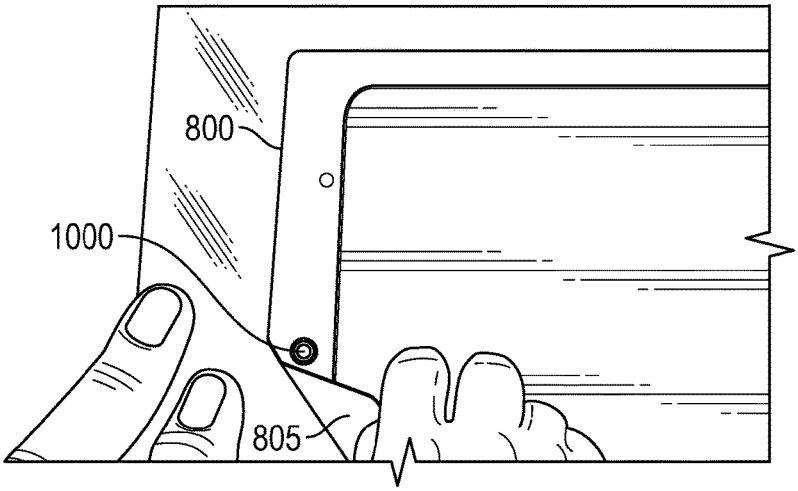
FIG. 10 illustrates opening the package of FIG. 8, and shows the tamper evident feature.

The opening of the package of this embodiment is illustrated beginning with FIG. 10. FIG. 10 shows the user beginning to peel open the label using the pull tab 805. In FIG. 10, the pull tab is been pulled just to the point where the adhesive starts separating, and where the tamper evident portion 1000 can be seen, but has not yet been disturbed. Note that there is no interruption in the colored or printed area, including the tamper evident portion 1000 in FIG. 10.

Figure 11:
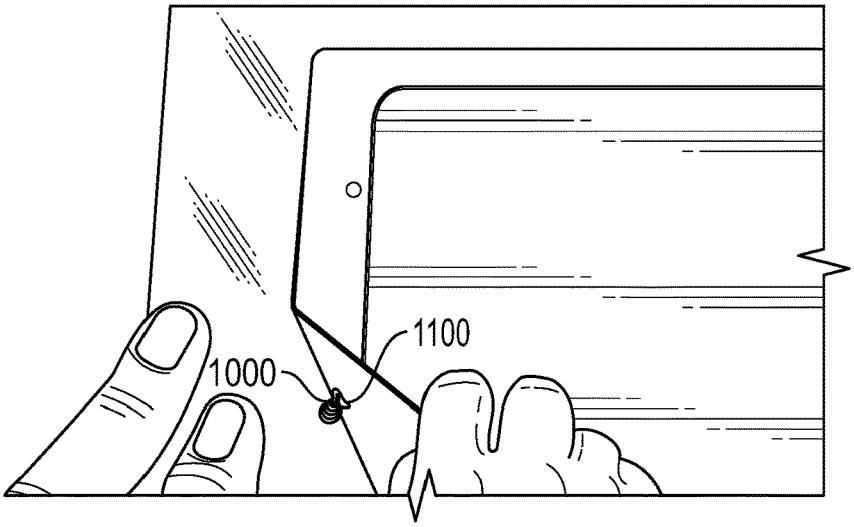
FIG. 11 shows the tamper evident feature beginning to be opened.

FIG. 11 illustrates continuing to pull open the package, past the tamper evident portion 1000. As the tamper evident portion is opened, the spiral which was formed in the label has been unraveled from the label. That label which has been removed is colored. The unraveled portion of the label is shown as 1000 in FIG. 11, beginning to unravel, and leaving an opening 1100 where the spiral has been unraveled. FIG. 11 shows how the tamper evident feature 1000, here the spiral coil pattern, is stretched out of shape.

Figure 12:
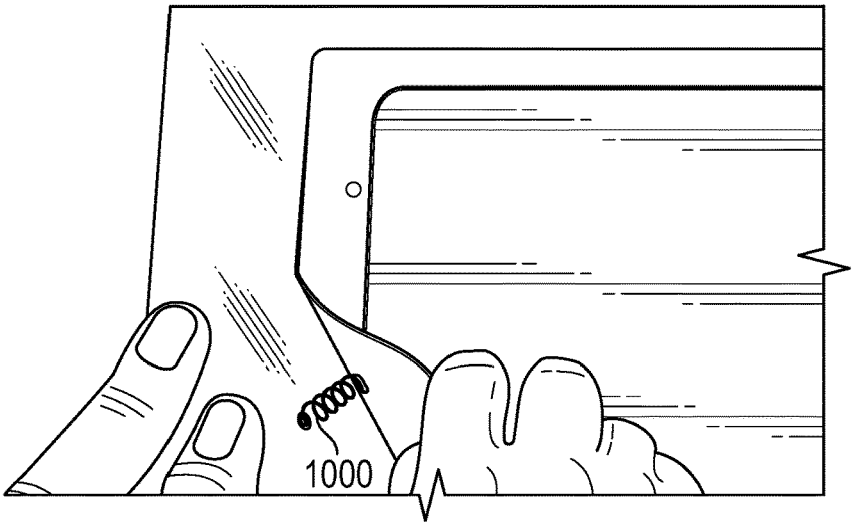
FIG. 12 illustrates further opening of the package of FIG. 8, showing the spiral unraveling even further.
Figure 13:
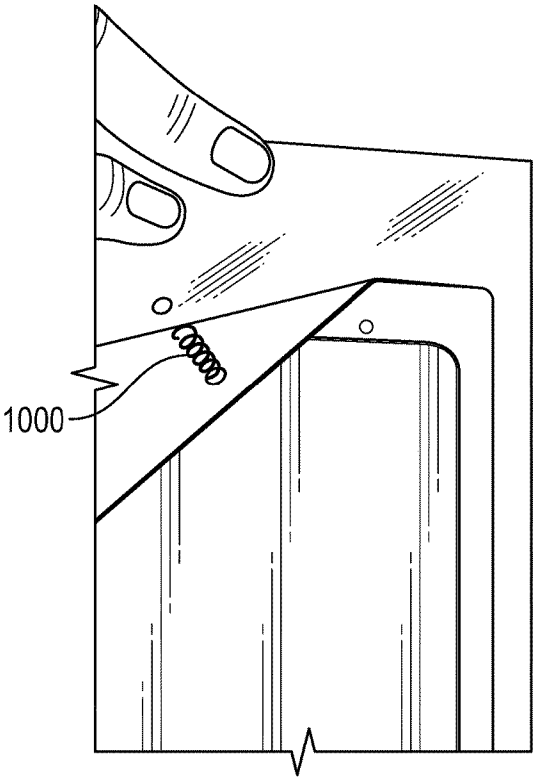
FIG. 13 illustrates the spiral being completely unraveled.

FIG. 12 shows further opening the package, where the coil 1000 is stretched and almost separated from the packaging material and the opening 1100 gets bigger in size as the helix or spiral unravels from the label. FIG. 13 shows the coil 1000 fully released and completely separated from the packaging material. The coil is stretched out of shape. Again, the opening 1100 is fully open without the spiral or helix inside.

Figure 14:
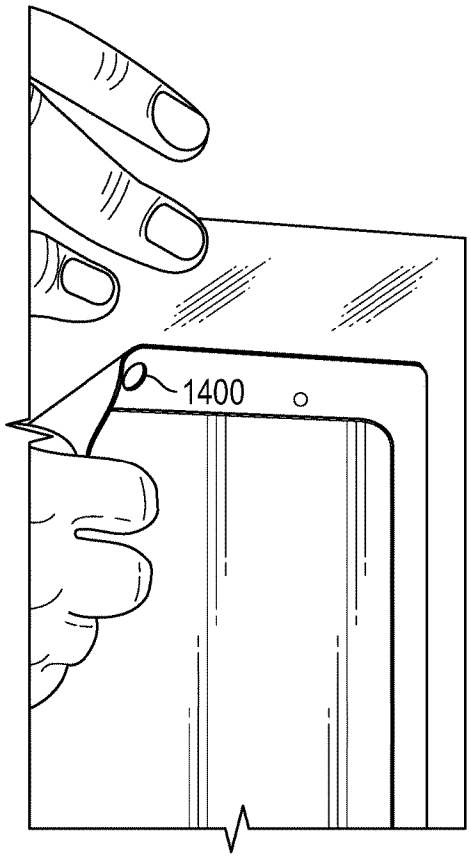
FIG. 14 shows resealing the package, and shows how the tamper evident portion can be seen clearly through the distortion of the colored or printed area caused by the unraveling of the helix.

If the user attempts to reclose the package, as shown in FIG. 14, the all-colored portion within the tamper proof feature 1000 in FIG. 8, has a noticeable portion where it is no longer completely colored, The clear Packaging material beneath can be seen thru the portion that has been removed, misplaced or unraveled from the PSA label at the tamper proof feature area. In different embodiments where a clear PSA labels is applied on clear Packaging material the stretched helix will form a bunch up area where the spiral cannot be re placed into its original position. It can be seen at a glance that the coil 1000 has been tampered with, thus forming a tamper evident feature.

Note that the coil is on a specific place on the packaging, so that a user can see at a glance whether the coil is complete or not complete by the consistent color or distortion of the area 1100.

Figure 15:
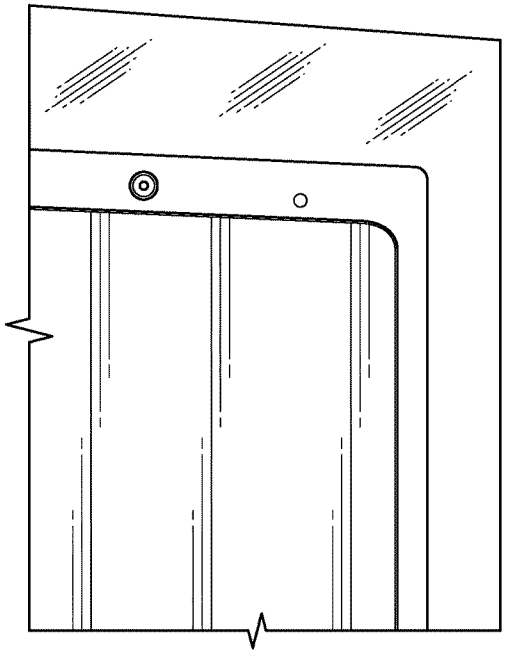
FIG. 15 shows the reclosed package and shows how the consistent colored or printed area has been changed by the opening and re-closing of the package.

Also, in this embodiment the PSA Label is printed and after opening or tampering, as shown in FIG. 15, the disrupted spiral exposes the clear packaging film beneath showing the package has been opened or tampered.

Figure 16:
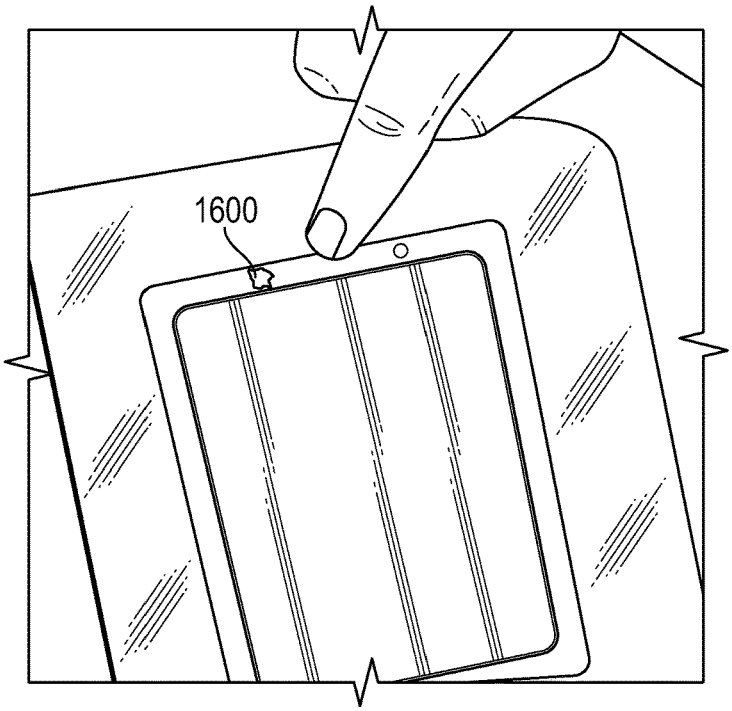
FIG. 16 shows a second embodiment in which printed words are used over the tamper evident feature.
Figure 17:
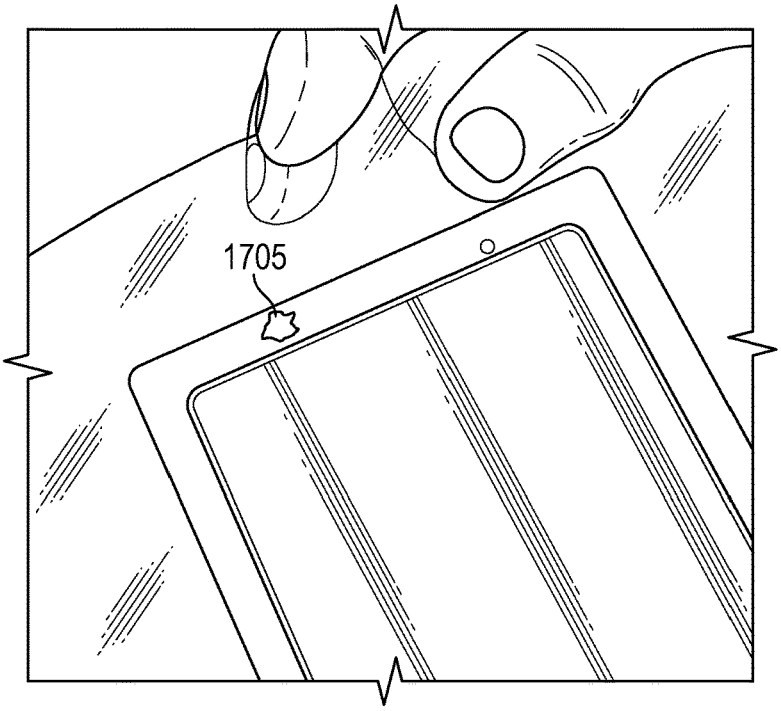
FIG. 17 shows the second embodiment having been opened so that the words can be easily seen as having been changed or distorted by the opening of the package.

FIG. 16 shows another embodiment in which a graphic or text is printed over the location where the concentric pattern is located, so that the graphic or text also becomes distorted or interrupted when the package is first opened. The words "tamper proof" 1600 is printed over the coil in FIG. 16. Opening the package causes the text to be distorted and the coil to unwind and be stretched out of shape. Attempting to reclose the package as shown in FIG. 17, changes the printed "tamper proof" 1705 so it can no longer be clearly read or at the very least it is immediately obvious that the words "tamper proof" are no longer consistent letters. The opening of the package distorts the text that is printed thereon.

In another embodiment, instead of words being printed at the location, a recognizable graphic can be printed at that location, which can be easily seen to be distorted once the package has been once opened.

Other embodiments are contemplated. For example, while the above embodiments have described a specific kind of tamper proof package, other packages are contemplated, other concentric patterns are contemplated, other graphics or text are contemplated to be printed on either the Packaging material or the PSA label, and the use of clear or transparent PSA labels are contemplated thereon in these embodiments.

Those of skill would further appreciate that these features can be carried out using different materials and different techniques different words and different shapes.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A tamper proof package, comprising:

a packaging material;

a removable label, attached to the packaging material using an adhesive, said removable label having a spiral shape formed thereon, where one end of the spiral shape is attached to the label and an other end is attached to the packaging material, in a way such that the spiral is extended when the package is opened by separating the label from the packaging material.

2. The package as in claim 1, wherein the spiral shape has an overall length which is less than a distance between the edge of the PSA label and the opening feature in the packaging material when the label is fully opened.

3. The package as in claim 1, wherein the spiral shape is a circular spiral.

4. The packaging material as in claim 1, wherein the spiral shape is in a shape having non-rounded corners.

5. The package as in claim 4, wherein the spiral shape is a triangular spiral.

6. The package as in claim 4, wherein the spiral shape is a rectangular spiral.

7. The package as in claim 1, wherein the spiral shape is elliptical and a wider edge of the ellipse extends in a direction perpendicular to a direction extending between an opening in the packaging material and an edge of the removable label.

8. The package as in claim 1, wherein the spiral shape has an outer perimeter in a way that covers less than two thirds of a length between an opening in the packaging material and an edge of the removable label.

9. The package as in claim 1, wherein the removable label has a first look prior to opening, and that first look changes to a second look after opening, where the change between the first look and the second look is caused by unraveling of the spiral during the opening of the package.

10. The package as in claim 9, wherein the first look is an area with a consistent color, and the second look is an area which has interruptions in the color, and the spiral shape is formed in the consistent color, and where unraveling the spiral shape causes the consistent color to show a different color.

11. The package as in claim 9, wherein the first look includes written words, and the second look includes interruptions in the written words, where the spiral shape is formed in the midst of the written words.

12. The package as in claim 9, wherein the first look includes a graphic and the second look includes interruptions in the graphic.

13. The package as in claim 12, wherein a size of an interruption in the first graphic is set by a size of the spiral.

14. The package as in claim 1, wherein the spiral shape having a "hook" or U shape at an end portion thereof where the shape meets the packaging material, and that in operation resists against the label from propagating or ripening when the label is pulled.

15. The package as in claim 1, wherein the spiral shape can be laser cut or mechanically die cut.

16. A tamper proof package, comprising:

a packaging material;

a removable label, attached to the packaging material using an adhesive, said removable label having a spiral shape that is cut on the label, where an end of the spiral shape where the spiral shape attaches to the packaging material has a feature thereon that in operation resists against the cut from the spiral shape propagating when the label is pulled.

17. The package as in claim 16, wherein the spiral is extended when the package is opened by separating the label from the packaging material.

18. The package as in claim 17, wherein the spiral shape has an overall length which is less than a distance between the edge of the PSA label and the opening feature in the packaging material when the label is fully opened.

19. The package as in claim 17, wherein the removable label has a first look prior to opening, and that first look changes to a second look after opening, where the change between the first look and the second look is caused by unraveling of the spiral during the opening of the package.

20. The package as in claim 19, wherein the first look is an area with a consistent color, and the second look is an area which has interruptions in the color, and the spiral shape is formed in the consistent color, and where unraveling the spiral shape causes the consistent color to show a different color.

21. The package as in claim 19, wherein the first look includes written words, and the second look includes interruptions in the written words, where the spiral shape is formed in the midst of the written words.

22. The package as in claim 19, wherein the first look includes a graphic and the second look includes interruptions in the graphic.

23. The package as in claim 22, wherein a size of an interruption in the first graphic is set by a size of the spiral.

24. A method of using a tamper proof package, comprising:

Attaching a removable label to a packaging material using an adhesive, said removable label having a spiral shape therein which is wholly in the plane of the label;

where the spiral shape is attached to the label and to the packaging material; and extending the spiral out of the plane of the label to extend the spiral when the package is opened by separating the label from the packaging material.

25. The method as in claim 24, wherein the spiral shape having a "hook" or U shape at an end portion thereof where the shape meets the packaging material, and that in operation resists against the label from propagating or ripening when the label is pulled.

* * * * *